United States Patent [19]

Francis

[11] 3,983,837

[45] Oct. 5, 1976

[54] RIBBON RE-INKING APPARATUS

[75] Inventor: Harold M. Francis, St. Paul, Minn.

[73] Assignee: Columbia-Great Lakes Corporation, Dayton, Ohio

[22] Filed: Jan. 8, 1975

[21] Appl. No.: 539,511

[52] U.S. Cl. ..... 118/7; 118/262; 118/235; 118/603

[51] Int. Cl.[2] ..... B05C 1/08; B05C 11/10

[58] Field of Search ..... 118/258, 259, 262, 235, 118/7, 603; 210/106

[56] References Cited

UNITED STATES PATENTS

| | | | |
|---|---|---|---|
| 1,734,293 | 11/1929 | Hellweg | 118/258 X |
| 2,007,729 | 7/1935 | Shallcross | 118/235 X |
| 2,092,623 | 9/1937 | Kuster | 210/106 |
| 2,649,758 | 8/1953 | Cowgill | 118/259 X |
| 2,991,753 | 7/1961 | Dearsley | 118/262 |
| 3,365,326 | 1/1968 | Conrad | 118/7 |
| 3,511,693 | 5/1970 | Davidson | 118/259 X |
| 3,605,682 | 9/1971 | Groce et al. | 118/7 |
| 3,737,338 | 6/1973 | Kabelitz | 118/7 X |

*Primary Examiner*—John P. McIntosh
*Attorney, Agent, or Firm*—Biebel, French & Nauman

[57] ABSTRACT

An improved ribbon re-inking apparatus having an improved means for holding and recirculating the re-inking composition comprising means for feeding and collecting the ribbon, means for driving the collecting means, inking means for applying re-inking composition to the ribbon, guide means for guiding the ribbon into contact with the inking means, and a supply means for providing a continuous supply of re-inking composition to be picked up and transfer to the ribbon, which supply means broadly comprises a closed reservoir means which holds a supply of re-inking composition, a relatively shallow open feed container which holds a pool of the composition to be picked up, a pump for continuously pumping the re-inking composition between the reservoir and the feed container, and a filter means for filtering the re-inking composition.

4 Claims, 3 Drawing Figures

RIBBON RE-INKING APPARATUS

CROSS REFERENCE TO RELATED APPLICATION

This application is related to copending application Ser. No. 539,512, filed Jan. 8, 1975, entitled REINKING APPARATUS.

BACKGROUND OF THE INVENTION

This invention is related broadly to apparatus for reconditioning printer ribbons, and specifically to an improved re-inking apparatus for such ribbons having a recirculation system for the re-inking composition.

Apparatus for re-inking printer ribbons is known in the art, and basically comprises a feed roller, quide rollers, take-up roller, and inking fountain. Also, some means is provided to set or adjust the feed rate of the re-inking composition by the fountain. This is helpful when re-inking computer printer ribbons where, because of their width, different flow rates along the width of the ribbon can result in an uneven coat of fresh ink. Generally, the adjustment means is some means which adjust the gap between the ductor and inking rollers which make up the inking fountain.

The re-inking composition used in re-inking ribbons generally, and computer printer ribbons specifically, is normally a carbon composition in the form of fine carbon particles dispersed in a relatively volatile liquid vehicle. After the re-inking composition is coated on the ribbon, the vehicle evaporates from the composition and leaves a fresh coating of the carbon composition on the "re-inked" ribbon.

In the re-inking process, the ductor roller rotates in an open container or reservoir containing a supply of the re-inking composition. The ductor roller picks up an amount of the composition on its surface and transfers some to the inking roller which is in rolling contact with the ribbon. In turn, the inking roller transfers an amount of the composition to the ribbon to coat or "re-ink" it.

In order to keep the carbon composition from settling out, the re-inking composition was circulated by pumping it from the reservoir and then back again. In addition, means was provided to filter the composition as it was recirculated in order to keep the re-inking composition free from contaminates. Filtration and recirculation are desirable when re-inking computer prints ribbons because they tend to have paper particles on their surface which become punched out of the paper on which the computer output is printed by the printing hammers of the computer printers. Such particles fall from the ribbon into the ink supply during re-inking and, if not filtered out, may be picked up and deposited on the re-inked ribbon.

While the use of an open container as the supply for the ink composition does not render the re-inking apparatus inoperative, it does present problems. The open container provides an opportunity for the vehicle in the re-inking composition to evaporate which results in a thickening of the composition. The feed of this composition depends to some extent on the surface tension of the composition, which is related to its viscosity or "thickness". A change in the viscosity or "thickening" of the composition results in a change of the rate of feed of the composition. This problem is further complicated by the fact that enough re-inking composition must be kept in the reservoir to provide a continuous supply along the length of the ductor roll and in doing so the re-inking composition tends to not move or to stagnate and allows for further evaporation. Still further, the size of the container usually could not be minimized because the walls of the container needed to be high enough to contain the splashing of the re-inking composition. This in turn resulted in the use of a container which was wider than necessary so that the ductor roll was in contact with the composition but not the walls of the container.

The changing viscosity of the re-inking composition can be compensated for to some extent by the use of an adjustment means which adjusts the gap between the ductor and the inking rollers. But, if the composition becomes too viscous, even the gap adjustment cannot provide sufficient compensation. When this happens, it becomes necessary to replace the composition with fresh re-inking liquid or to "thin-out" the composition in the reservoir by adding more vehicle or a solvent. Such a process can be messy when dealing with carbon compositions, and further is undesirable since it means a period of "down time" when the re-inking apparatus cannot be used.

Therefore, a need exists for an improved re-inking apparatus having an improved means for holding and recirculating the re-inking composition.

SUMMARY OF THE INVENTION

The invention is broadly an improved ribbon re-inking apparatus having an improved means for holding and recirculating the re-inking composition. Basically, the apparatus comprises means for feeding and collecting the ribbon, means for driving the collecting means, inking means for applying a re-inking composition to the ribbon, guide means for guiding the ribbon into contact with the inking means, and the improved supply means for holding and recirculating the composition. The improved supply means provides a continuous supply of re-inking composition, which the ductor roller picks up and transfers to the inking roller which subsequently transfers it to the ribbon, while minimizing the exposure of the composition and consequential evaporation of the vehicle from the composition.

In the preferred embodiment, the supply means comprises a reservoir container which is a closed container and which holds a supply of re-inking composition, a feed container which is a relatively shallow open container and which holds an amount of or pool of the composition, some of which the ductor or feed roller will pick up on its surface while rotating therein, an overflow such as a catch pan for collecting the composition which overflows the feed container and returning it to the reservoir, a pump for continuously pumping the composition from the reservoir container to the feed container, appropriate piping connecting the reservoir, the feed container, and the overflow container, and a filter to filter the composition before it is returned to the reservoir.

In operation, re-inking composition is pumped from the reservoir container to the feed container. The ductor roller rotating in the feed container will pick up an amount of the composition for subsequent application to the ribbon. Because the feed container is relatively shallow, a lesser amount of composition is contained in the feed or ductor container and the amount of vehicle evaporation is minimized. Further, the surface area is reduced. The feed container need not have high side walls to contain the splashing because the splashing will be contained by the overflow container. The feed container can be allowed to fill and overflow. The overflowing re-inking liquid is caught by the catch pan, i.e., the overflow container, which returns the overflow composition to the reservoir container. Because the flow is continuous, there is less chance for the composition to stagnate and the vehicle to evaporate. From the catch pan the composition is returned to the reservoir via a filter which will remove any impurities, paper particles, and the like.

In order to improve the distribution of the liquid composition in the feed container or pan which will not be as deep as a conventional ductor or feed container, a manifold pipe can be used to distribute the composition. Further, sensing means can be employed to indicate a low liquid level or supply in the reservoir container and a high liquid level in the filter or a need to clean the filter. Still further, a gravity supply means can be used to add fresh composition to the closed container essentially automatically. Thus, the improved re-inking apparatus of the invention provides an improved means for holding and recirculating the re-inking composition.

It is therefore an object of this invention to provide an improved means for holding and recirculating the re-inking composition for a ribbon re-inking apparatus which provides an adequate and continuous supply of re-inking composition while minimizing evaporation problems.

These and other objects and advantages of the invention will be apparent from the following description, the accompanying drawings and the appended claims.

DETAILED DESCRIPTION OF THE INVENTION

Figure 1:
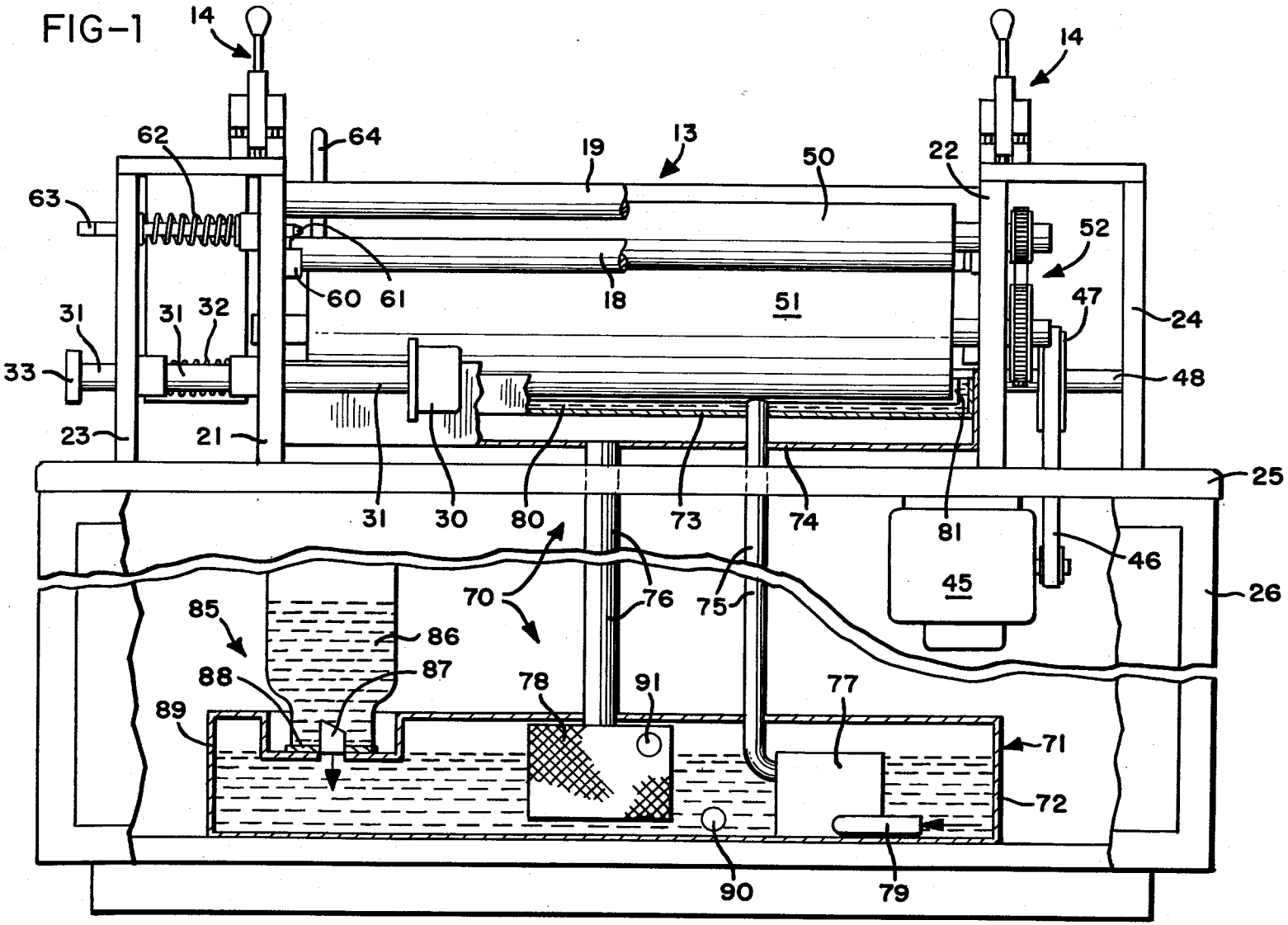
FIG. 1 is a front elevational view, partially in cross-section and partially broken away, of an improved re-inking apparatus in accordance with the present invention.
Figure 2:
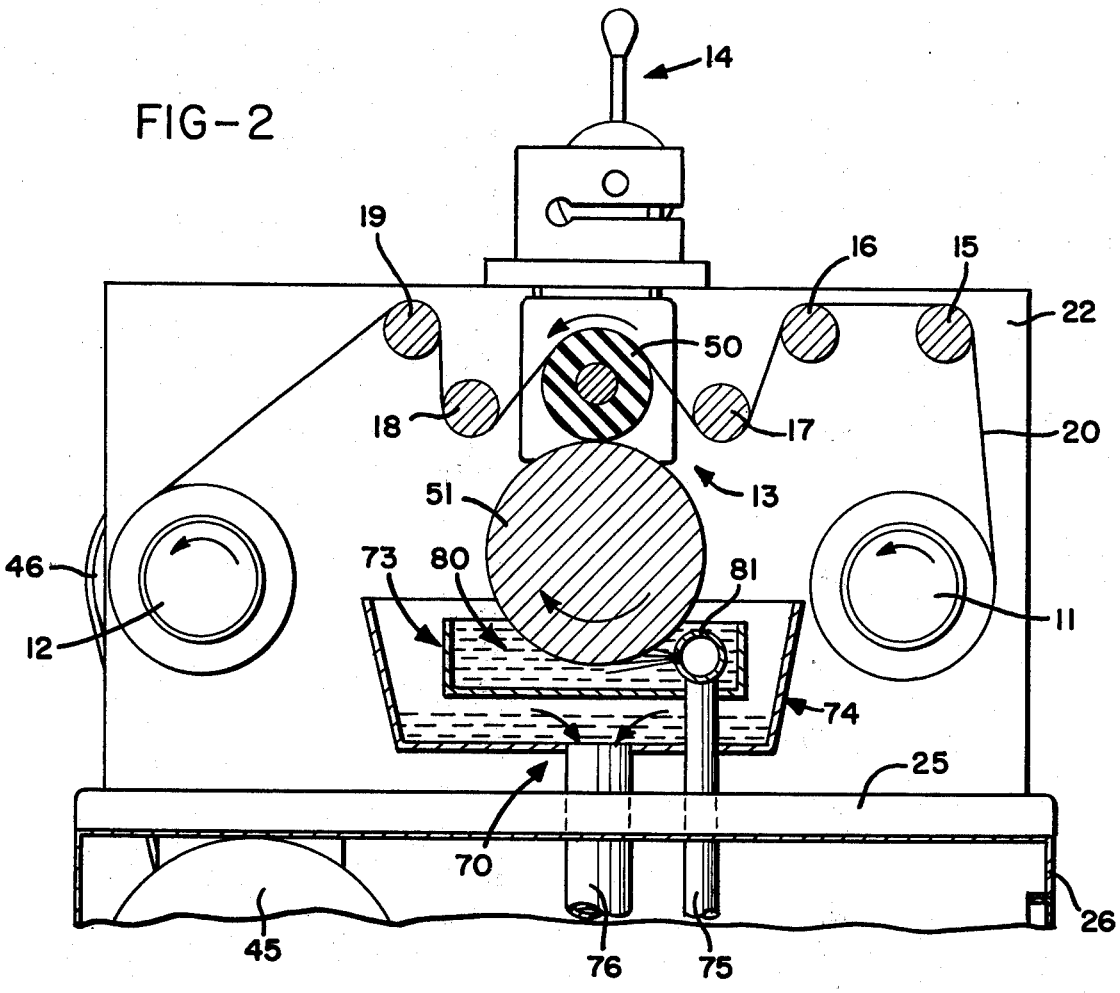
FIG. 2 is a cross-sectional view, partially broken away, of the re-inking apparatus of FIG. 1.

As shown in FIGS. 1 and 2, the basic re-inking apparatus 10 comprises a feed roller means 11, take-up or collecting roller means 12, and inking fountain 13 located centrally between the feed and collecting rollers, and control means 14 for controlling the amount of flow of the re-inking composition. Guide bars 15–19 provide a means to guide a ribbon 20 toward and away from fountain 13 where it will become recoated for subsequent reuse.

Vertical end plates 21–24, with plates 21 and 22 being inside and plates 23 and 24 being outside, are provided to support the roller, guide and the inking means, while base plate 25 in turn supports the end plates 21–24. Base plate 25 may itself be supported as by placing it on or making it a part of a cabinet 26 or the like which can be used to store supplies as well as housing motors to drive the take-up roller means and the recirculation system for the re-inking liquid (to be discussed in more detail hereinafter).

Feed and take-up roller means 11 and 12 are rotatably supported by end plates 21–24, while guide bars 15–19 are fixed between plates 21 and 22 and have a chrome-plated surface or the like, over which the ribbon will slide. Alternatively, some or all of the guide bars 15–19 could be rotatably mounted.

Feed roller means 11 comprises a pair of identical spools which are rotatably supported by journals or shafts which are axially slidable as well as rotatable, in end plates 21–24. Only one spool 30 and shaft 31 are shown, in FIG. 1. The remaining portion of feed roller means 11 is broken away in order to expose for purposes of illustration the other parts of the apparatus. Collars, such as collar 33, at the ends of the shafts 31, limit axial movement in one direction, while the spools 30 limit axial movement in the other direction. The spools 30 are of a conventional construction and are adapted to support between them a hollow cylindrical core (not shown) on which the ribbon 20 is wound or coiled. The spools 30 are inserted inside the core by moving the shafts 31 axially away from and then towards one another. The core having the ribbon 20 thereon will be pinned between the spools which fit inside the core and are frictionally engaged by the spools 31. Together they will be free to move axially, essentially as a unit, to adjust for winding irregularities which might have occurred when the ribbon was initially wound on the core. An alternative to having the core frictionally held on the spools is to have the spools spring-biased toward one another by an appropriate means which also allows the feed means to move axially as a unit to adjust for winding irregularities.

The take-up means 12 is basically the same as the feed means 11 in that spools (not shown) support a core (not shown) which is placed between them and upon which the re-inked ribbon will be collected by winding in a conventional manner, such as by wrapping the ribbon on the core for a first turn which frictionally holds the rest on. However, the shafts for the take-up means are not free to move axially, as in the case of shafts 31, when the apparatus is in operation. The take-up shafts are mounted for rotation in end plates 21 and 23, and one of them is axially movable to allow a core to be mounted between the spools, while being spring-biased by a spring 32 to restrain the take-up or collecting roll means 12 from otherwise moving axially. The other collecting roll shaft is mounted for rotation in end plates 22 and 24, and is fixed against axial movement.

Thus, one of the shafts of the take-up means 12 can be manually shifted axially by overcoming the spring to insert a core between the spools. The spring will return the movable spool towards the fixed spool and hold the core in place. The take-up means 12 is rotatably driven by motor 45 through a drive belt 46 which is connected over a driven pulley 47 on shaft 48, located between the inner and outer end plates 22 and 24. This drive means in turn drives an inking roller 50 because of frictional contact of the ribbon being re-inked with the peripheral surface of that roller. Roller 50 has a somewhat resilient surface, as of rubber or a suitable synthetic polymer. Liquid re-inking composition is transferred to it from a metal feed roller 51, which preferably is chrome plated. Since inking roller 50 and feed or ductor roller 51 are closely spaced but not in tight frictional contact, they are interconnected by a timing means, shown generally at 52 in FIG. 1, which is conventional in the art and which comprises a toothed timing belt interconnecting timing gears on the shafts of the feed roller 51 and inking roller 50 as well as an idler roller and a tension roller (not shown). The tension roller is spring-loaded to provide the tension necessary to keep the timing belt in contact with the timing gears and to compensate for adjustments in the spatial relationship between the feed and inking rollers 51 and 50.

As shown in FIG. 2 an installed ribbon 20 must pass over guide bars 15 and 16, under guide bar 17, over inking roller 50, under guide bar 18, and over guide bar 19 to take-up means 12. For ease in installation, guide bars 17 and 18 which hold the ribbon 20 in contact with inking roller 50 are pivotally connected to end wall 22 by means of conventional pivots (not shown). The opposite ends thereof are supported in end wall 21 by U-shaped supports 60 and retained therein by latch pins 61 which are spring-loaded inward by springs 62. In order to move guide bars 17 and 18 out of the way so that a ribbon 20 may be installed, latches 61 are pulled axially out of the way by handle 63, overcoming springs 62. By grasping handle 64 which interconnects guide bars 17 and 18, the guide bars can be swung upward out of the way. The ribbon 20, mounted on a core, is supported between spools 30 of feed means 11 and is passed over guides 15, 16 and 19 into engagement with a core (not shown) supported by the spools of collection means 12. When guide bars 15 and 17 are pivoted back into place they will come down on ribbon 20 on either side of inking roller 50, and guide a substantial part of ribbon 20 into contact with roller 50.

The description of the basic re-inking apparatus, up to this point, is generally conventional in the art. It is the storing, handling and feeding of the re-inking composition which is the improvement involved in this application and which will hereinafter be discussed in detail.

In operation, feed or ductor roller 51 of fountain 13 picks up an amount of the liquid re-inking composition on its surface and transfers it to inking roller 50 which subsequently transfers it to ribbon 20. The feed roller 51 picks up the ink from a feed means, indicated generally at 70.

Feed means 70 generally comprises a closed container or reservoir 71 for holding a supply of the ink composition 72, a relatively shallow open feed container 73, a collection means for collecting the overflow from feed container 73, such as catch pan 74, inlet pipe 75 and return pipe 76, which connect the reservoir 71 and feed container 73, a pump 77 which circulates the re-inking composition 72 through the containers via pipe 75 and 76, and a filter 78 which removes any impurities in the ink, such as dirt, paper particles and the like. In operation, the re-inking composition 72 is drawn from the reservoir 71 by the intake pipe 79 of pump 77, and feed through inlet pipe 75 to container 73. The pool 80 of liquid composition in the feed container 73 provides the supply from which the inking fountain 13 draws to coat the ribbon 12. Normally, the feed container 73 will be filled to capacity with the flow rate from pump 77 being greater than the amount of ink composition picked up by feed roller 51. The pool 80 overflows into catch pan 74 where it is collected and returned by gravity to reservoir 71 by pipe 76, through filter 78.

The arrangement of feed means 70 is not limited to the arrangement shown in FIGS. 1 and 2, and so modifications which achieve the same results are contemplated. For example, the reservoir need not be located directly beneath feed container 73, but could be located to one side or above feed container 73 and the pump rearranged such that the re-inking composition would flow by gravity to feed container 73 and be pumped back to the reservoir. Further, the re-inking composition in feed container 73 could overflow through an opening in the side wall of the container instead of over the top of the side wall.

Since feed container 73 is rather shallow, a distribution manifold 81 may be provided, comprising a pipe connected to inlet pipe 75 and running the length of the feed container 73. The manifold has a plurality of small openings along its length from which re-inking liquid exits at a number of locations into container 73.

means 85 is provided to supply fresh ink composition to reservoir 71, in the form of a gravity flow system comprising a replaceable inverted bottle 86 containing fresh re-inking composition, which discharges into reservoir 71 by tube 87. The connection between bottle 86 and reservoir 71 is made by inverting the bottle and piercing its sealed top 88 on the pointed end of the tube. Bottle 86 is thus sealed by gasket/top 88 until it is used, and then its seal assures a closed connection into the contents of the bottle by engaging the exterior of tube 87. When the fluid level of the re-inking composition 72 drops below the mouth of bottle 86 the fresh re-inking composition is gravity fed to reservoir 71, since it is the fluid pressure of the ink composition 72 in reservoir 71 which holds the fresh ink composition in bottle 86. In this way the addition of fresh re-inking composition is essentially automatic.

Figure 3:
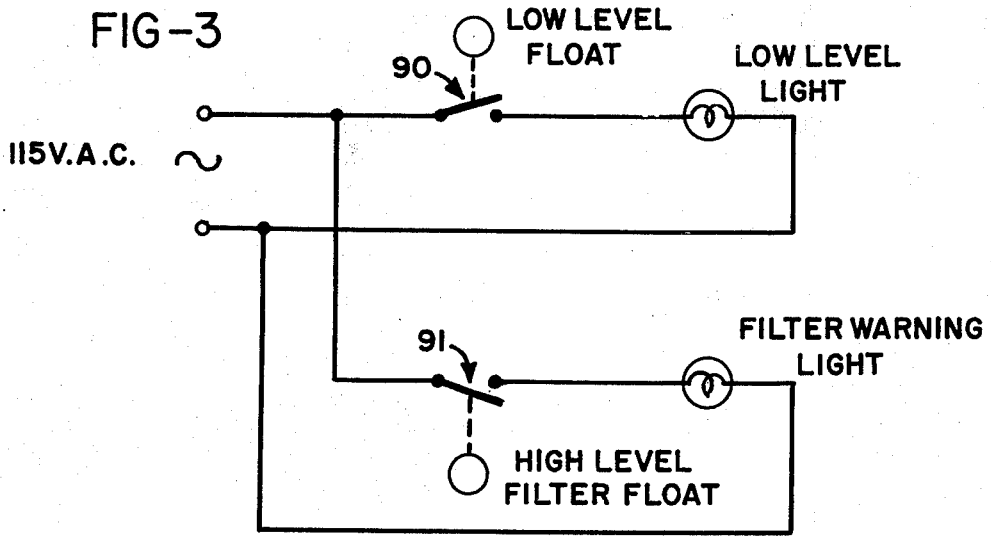
FIG. 3 is a schematic diagram illustrating the wiring in the high and low level sensors employed in the re-inking apparatus of this invention.

Low level sensor 90, such as a conventional small float operated switch as illustrated in FIG. 3 is provided to indicate when the composition 72 is below a predetermined amount. This will prevent the pump from burning out due to cavitation, as well as indicate to the operator the need for fresh re-inking composition. Further, a similar high level sensor 91 which also is shown in FIG. 3, is provided in filter 78 to indicate accumulation of liquid therein which is indicative of reduced flow through the filter and the need to clean it.

The spatial relationship between the feed roller 51 and inking roller 50, i.e., the spacing or gap, determines the amount of re-inking composition transferred from the feed roller 51 to the inking roller 50 and consequently to the ribbon 20. The control of this spatial relationship can be done in any conventional manner. One arrangement for controlling this spacing is disclosed in copending application Ser. No. 539,512 filed Jan. 8, 1975, and is shown generally in the drawings at 14.

While the form of apparatus herein described constitutes a preferred embodiment of the invention, it is to be understood that the invention is not limited to this precise form of apparatus, and that changes may be made therein without departing from the scope of the invention.

What is claimed is:

1. In apparatus for reinking ribbons with a relatively volatile reinking liquid, including feeding and collecting means arranged to guide a ribbon to be reinked along a predetermined path, an inking roller supported along said path to contact the ribbon for applying a reinking liquid to the ribbon so that it can be reused, a feed roller mounted adjacent said inking roller for transferring reinking liquid from a supply means to said roller means;

an improved system for supplying reinking liquid to said feed roller, comprising a closed reservoir for holding a supply of reinking liquid, a shallow feed container located separately from said reservoir and having walls in closely adjacent relation to said feed roller for holding a shallow pool of reinking liquid of predetermined depth in contact with said feed roller, said feed container being arranged to overflow liquid continually over the top thereof to maintain the pool at constant depth, an open top catch pan mounted immediately below said feed container to receive all overflow from said feed container, a return pipe extending from the bottom of said catch pan to said reservoir to conduct the overflow immediately out of said catch pan, a filter connected to said return pipe and located adjacent the top of said reservoir receive the entire flow through said return pipe and operative to remove contaminant carried into the overflow and to return only filtered liquid to said reservoir, and a pump connected and arranged to maintain a supply of reinking liquid from said reservoir into said feed container at a rate in excess of the demand of said feed roller.

2. Apparatus as defined in claim 1 wherein said reservoir also includes a refill tube extending upwardly from said reservoir, opening at the lower end of said tube terminating above the bottom of said reservoir at the desired normal liquid level in said reservoir, the upper end of said refill tube including means for engaging an inverted closed bottle of the re-inking liquid in sealed relation whereby liquid in the bottle and in said reservoir is kept under closed conditions to minimize evaporation thereof.

3. Apparatus as defined in claim 2, further including means for sensing and indicating low liquid level in said reservoir to indicate the need to replace an empty bottle with a full bottle.

4. Apparatus as defined in claim 1 further including indicator means responsive to raising of liquid level in said filter above the normal level in said reservoir indicative of reduced flow through said filter requiring cleaning of said filter.

* * * * *